US011136752B2

(12) United States Patent
Kashirajima et al.

(10) Patent No.: US 11,136,752 B2
(45) Date of Patent: Oct. 5, 2021

(54) FLUSH TOILET

(71) Applicant: TOTO LTD., Kitakyushu (JP)

(72) Inventors: Shu Kashirajima, Kitakyushu (JP); Takahiro Hara, Kitakyushu (JP); Masaki Mori, Kitakyushu (JP); Yukari Kawazu, Kitakyushu (JP); Tsubasa Ishibashi, Kitakyushu (JP); Hironori Yamasaki, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/824,356

(22) Filed: Mar. 19, 2020

(65) Prior Publication Data

US 2020/0308816 A1 Oct. 1, 2020

(30) Foreign Application Priority Data

Mar. 29, 2019 (JP) ..... JP2019-066070

(51) Int. Cl.

| | |
|---|---|
| ***E03D 1/01*** | (2006.01) |
| ***E03D 1/012*** | (2006.01) |
| ***E03D 5/01*** | (2006.01) |
| ***E03D 1/38*** | (2006.01) |
| ***E03D 1/26*** | (2006.01) |

(52) U.S. Cl.

CPC ..... *E03D 1/01* (2013.01); *E03D 1/012* (2013.01); *E03D 1/26* (2013.01); *E03D 1/38* (2013.01); *E03D 5/01* (2013.01)

(58) Field of Classification Search

CPC .. E03D 1/01; E03D 1/012; E03D 1/26; E03D 1/38; E03D 5/01

USPC ..... 4/328, 329, 332

See application file for complete search history.

(56) References Cited

U.S. PATENT DOCUMENTS

| | | | | |
|---|---|---|---|---|
| 2010/0077544 | A1* | 4/2010 | Okubo | E03D 5/01 4/354 |
| 2017/0089052 | A1* | 3/2017 | Ishimaru | E03D 5/01 |

FOREIGN PATENT DOCUMENTS

| | | | |
|---|---|---|---|
| CN | 107816097 | A | 3/2018 |
| CN | 108691341 | A | 10/2018 |
| JP | S56-16749 | A | 2/1981 |
| JP | 2016-180305 | A | 10/2016 |

OTHER PUBLICATIONS

Office Action issued in JP 2019-066070; mailed by the Japanese Patent Office dated Sep. 10, 2020.

* cited by examiner

*Primary Examiner* — Tuan N Nguyen

(74) *Attorney, Agent, or Firm* — Studebaker & Brackett PC

(57) ABSTRACT

A flush toilet includes a toilet main body, a flush water tank device, and connection conduits for supplying, to a toilet main body, flush water supplied from a reservoir tank. The reservoir tank includes a large tank portion on a large volume side in the reservoir tank when the reservoir tank is divided into two at the left-right center and a small tank portion on a small volume side in the reservoir tank when the reservoir tank is divided into two at the left-right center. The upstream end of one connection conduit is connected to the large tank portion and, on the other hand, the downstream end of the other connection conduit is connected to the other side of the toilet main body divided into two at the left-right center.

7 Claims, 5 Drawing Sheets

FLUSH TOILET

CROSS-REFERENCE TO RELATED APPLICATION

This application claims benefit of priority to Japanese Application No. 2019-066070, filed Mar. 29, 2019, the entire content of which is incorporated herein by reference.

BACKGROUND

Technical Field

The present disclosure relates to a flush toilet and, more particularly, to a flush toilet configured to discharge waste by flushing the flush toilet with flush water.

Background Art

In recent years, there has been an increasing demand for so-called "low silhouetting" for designing the upper end of an entire toilet main body incorporating a tank, which stores flush water, as low as possible for the purpose of improvement of designability of a flush toilet.

Therefore, as a flush toilet in the past that is cleaned by flush water and discharges waste, there has been known a flush toilet in which two separate flush water tanks (a first tank and a second tank), in which flush water for toilet cleaning is stored, are respectively housed in housing spaces behind and below a bowl of a toilet main body in order to secure a tank capacity while realizing low silhouetting of the toilet main body as described in, for example, Japanese Patent Laid-Open No. 2016-180305.

However, in the flush toilet in the past explained above, in particular, various functional components are disposed around the first tank housed behind the bowl of the toilet main body. Consequently, a tank shape is formed in an asymmetrical distorted shape to avoid interference with these peripheral functional components.

In the flush toilet in the past explained above, since the first tank is disposed above the floor surface, the first tank having the asymmetrical distorted shape is likely to tilt when the first tank is not firmly fixed. Further, if such a first tank tilts and topples, the first tank is likely to collide with the toilet main body and the floor to be broken.

SUMMARY

Therefore, the present disclosure provides a flush toilet that can prevent an entire flush water tank from greatly tilting to thereby collide with a toilet main body and a floor surface to be broken.

That is, the present disclosure provides a flush toilet configured to discharge waste by flushing the flush toilet with flush water, the flush toilet comprising: a toilet main body including a bowl configured to receive the waste, a discharge trap configured to discharge the waste in the bowl, and a tank compartment; a flush water tank device provided above a floor surface and including a reservoir tank configured to store flush water supplied to the toilet main body, the reservoir tank being set in the tank compartment of the toilet main body; a connection conduit configured to connect the reservoir tank and the toilet main body and supply, to the toilet main body, the flush water supplied from the reservoir tank. The reservoir tank includes a large tank portion having a large volume in the reservoir tank when the reservoir tank is divided into two at a left-right center and a small tank portion having a small volume in the reservoir tank when the reservoir tank is divided into two at the left-right center. The large tank portion is disposed in the tank compartment formed on one side of the toilet main body divided into two at the left-right center, while the small tank portion is disposed in the tank compartment formed on other side of the toilet main body divided into two at the left-right center. An upstream end of the connection conduit is connected to the large tank portion, while a downstream end of the connection conduit is connected to the other side of the toilet main body divided into two at the left-right center.

In the present disclosure configured in this way, in a state in which the reservoir tank is set in the tank compartment of the toilet main body, since the volumes of the large tank portion and the small tank portion of the reservoir tank of the flush water tank device are different, imbalance of weight in the reservoir tank occurs. Consequently, in some case, a tilt that places the large tank portion below and places the small tank portion above occurs and a force for tilting the entire horizontal reservoir tank acts on the reservoir tank.

However, even in a state in which such the force for tilting the entire reservoir tank occurs, since the upstream end of the connection conduit is connected to the large tank portion and the downstream end of the connection conduit is connected to the other side of the toilet main body divided into two at the left-right center, the entire connection conduit can effectively restrain a tilting movement of the entire reservoir tank. Consequently, it is possible to maintain, in the horizontal state, the entire reservoir tank set in the tank compartment. Therefore, it is possible to prevent the entire reservoir tank set in the tank compartment from greatly tilting to thereby collide with the toilet main body and the floor surface to be broken.

In the present disclosure, preferably, at least a part of the large tank portion is disposed on an outer side of the discharge trap in the tank compartment which is formed on one side of the toilet main body divided into two at the left-right center, and at least a part of the small tank portion is disposed on an outer side of the discharge trap in the tank compartment which is formed on the other side of the toilet main body divided into two at the left-right center. In the present disclosure configured in this way, as a space for setting each of the large tank portion and the small tank portion of the reservoir tank, a peripheral space on the outer side of the discharge trap can be used as a part of the tank compartment of the toilet main body. Therefore, it is possible to sufficiently secure the volume in the flush water tank, in which the flush water is stored, while limiting a height position of the entire reservoir tank.

Therefore, it is possible to realize so-called "low silhouetting" for designing the height of the entire flush toilet including the toilet main body and the tank body low. Therefore, it is possible to improve a design property of the entire flush water toilet.

In the present disclosure, preferably, the discharge trap is provided at the left-right center of the toilet main body, and the upstream end of the connection conduit is connected to a discharge trap side surface of left and right side surfaces of the large tank portion. In the present disclosure configured in this way, the discharge trap is provided at the left-right center of the toilet main body and the upstream end of the connection conduit is connected to the side surface on the discharge trap side of the left and right side surfaces of the large tank portion. Therefore, it is possible to position the upstream end of the connection conduit closer to the left-right center of the toilet main body.

Consequently, it is possible to suppress the length and the height of the entire connection conduit from the upstream end of the connection conduit positioned closer to the left-right center of the toilet main body to the downstream end of the connection conduit connected to the other side of the toilet main body divided into two at the left-right center. Therefore, it is possible to realize low silhouetting of the flush toilet.

In the present disclosure, preferably, the connection conduit includes a pump configured to pressure-feed the flush water from the reservoir tank to a downstream side of the connection conduit; and a water supply pipe line configured to supply the flush water pressure-fed by the pump to the toilet main body. In the present disclosure configured in this way, the pump can be incorporated in a part of the connection conduit. The connection conduit can also be used as the water supply pipe line for supplying the flush water pressure-fed by the pump to the toilet main body.

Therefore, functions from the pressure-feeding of the flush water in the reservoir tank to the supply of the flush water to the toilet main body can be integrated in the connection conduit. Therefore, it is possible to suppress the number of components and manufacturing cost. It is possible to efficiently perform toilet cleaning.

In the present disclosure, preferably, the pump is disposed behind the bowl and above the discharge trap. In the present disclosure configured in this way, the pump is disposed behind the bowl of the toilet main body and above the discharge trap. Therefore, it is possible to secure a work space in performing connection work, maintenance work, and the like in the pump.

Therefore, it is possible to easily perform maintenance and inspection and the like of the pump. It is possible to reduce a workload.

In the present disclosure, preferably, the pump is provided further on the left-right center side of the toilet main body than the upstream end and the downstream end of the connection conduit. In the present disclosure configured in this way, the pump is provided further on the left-right center side of the toilet main body than the upstream end and the downstream end of the connection conduit. Therefore, it is possible to set, in a well-balanced state, the length of a suction path for the pump to suck the flush water from the inside of the reservoir tank and the length of a supply path (a water supply pipe line) for pressure-feeding the flush water from the pump to the toilet main body.

Therefore, since it is possible to efficiently supply the flush water in the reservoir tank to the toilet main body with such a pump, it is possible to improve cleaning performance of the toilet.

In the present disclosure, preferably, a bottom surface of the large tank portion is located below a bottom surface of the small tank portion, and a suction pipe connected to the upstream end of the connection conduit is provided in the large tank portion, and the pump is configured to suck the flush water in the reservoir tank from the suction pipe into the connection conduit during operation. In the present disclosure configured in this way, the suction pipe is provided in the large tank portion and the suction pipe is connected to the upstream end of the connection conduit. Consequently, it is possible to efficiently supply the flush water in the reservoir tank to the toilet main body during the operation of the pump.

With the flush toilet of the present disclosure, it is possible to prevent the entire reservoir tank from greatly tilting to collide with the toilet main body and the floor surface to be broken.

DETAILED DESCRIPTION

A flush toilet according to an embodiment of the present disclosure is explained below with reference to the accompanying drawings.

Figure 1:
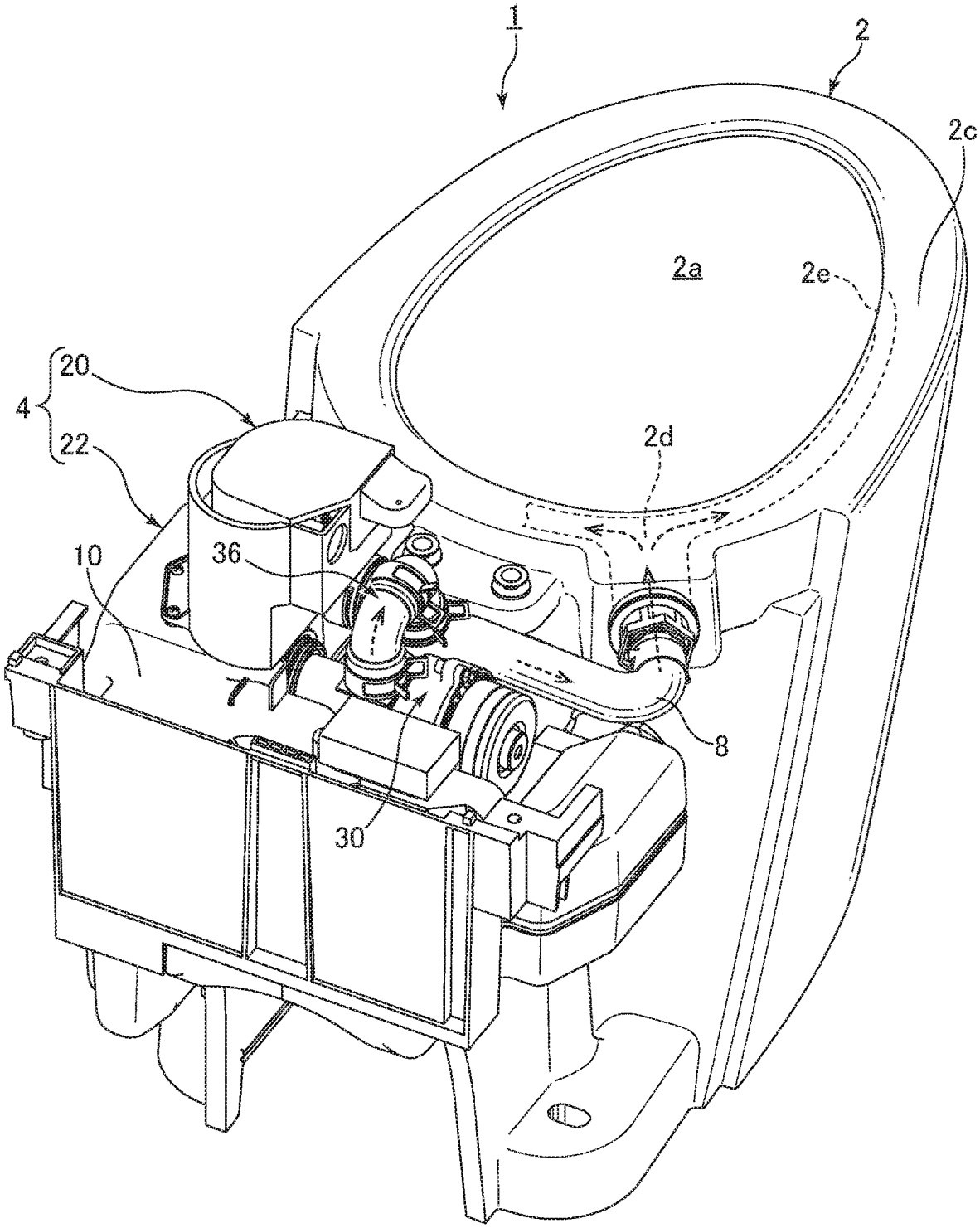
FIG. 1 is a schematic perspective view of a flush toilet according to an embodiment of the present disclosure viewed from obliquely behind and above.
Figure 2:
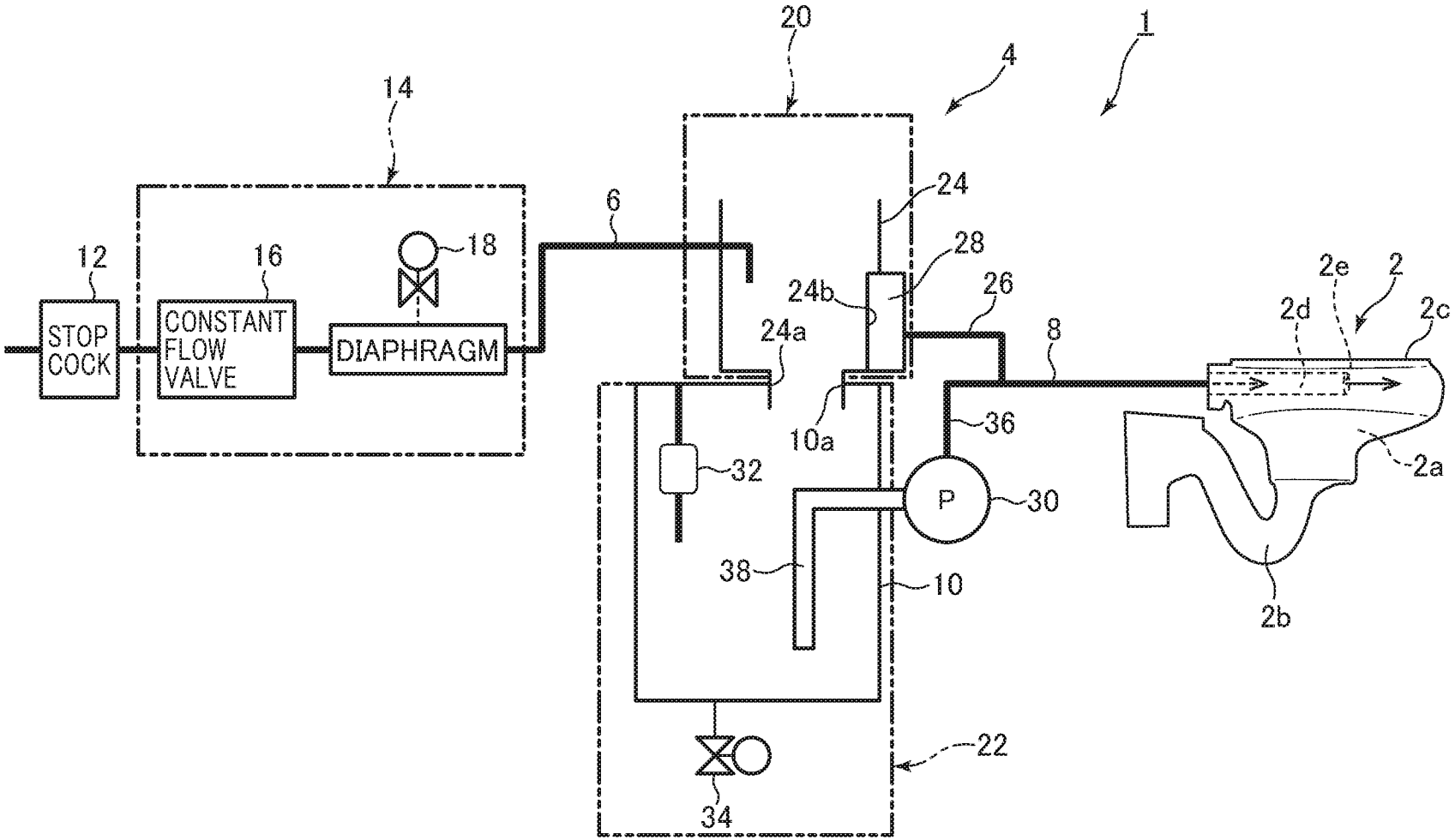
FIG. 2 is an overall configuration diagram of the flush toilet according to the embodiment of the present disclosure.

FIG. 1 is a schematic perspective view of the flush toilet according to the embodiment of the present disclosure viewed from obliquely behind and above. FIG. 2 is an overall configuration diagram of the flush toilet according to the embodiment of the present disclosure.

As shown in FIGS. 1 and 2, a flush toilet 1 according to the embodiment of the present disclosure includes a toilet main body 2 and a flush water tank device (a tank device 4) provided on the rear side of the toilet main body 2. The toilet main body 2 includes a bowl 2*a* that receives waste, a discharge trap (a discharge trap conduit 2*b*) that extends from the bottom of the bowl 2*a* and discharges the waste in the bowl 2*a*, and a rim 2*c* formed at the upper edge of the bowl 2*a*.

As shown in FIGS. 1 and 2, the tank device 4 includes a water supply pipe 6 and a spouting pipe 8 respectively connected to the upstream side and the downstream side of the tank device 4. The upstream side of the water supply pipe 6 is connected to an external water supply source (not shown in FIGS. 1 and 2) such as a water service. On the other hand, the downstream side of the water supply pipe 6 is connected to a reservoir tank 10 (explained in detail below) of the tank device 4. Consequently, flush water is supplied from the water supply pipe 6 to the reservoir tank 10.

A stop cock 12 and a valve unit 14 are respectively provided in the water supply pipe 6 from the upstream side toward the downstream side. Further, the valve unit 14 includes a constant flow valve 16 provided in the water supply pipe 6 and a diaphragm-type electromagnetic valve 18 provided on the downstream side of the constant flow valve 16.

As shown in FIGS. 1 and 2, the tank device 4 further includes a connecting unit 20 connected to the downstream side of the valve unit 14 of the water supply pipe 6 and a tank unit 22 connected to the downstream side of the connecting unit 20 and including the reservoir tank 10. In the valve unit 14, the flush water in the water supply pipe 6, a flow rate of which is adjusted to be constant by the constant flow valve 16 is supplied to the connecting unit 20 by opening and closing of the electromagnetic valve 18 and thereafter supplied from the connecting unit 20 to the tank unit 22.

As shown in FIG. 2, the connecting unit 20 includes a housing 24, an overflow pipe 26, and a check valve 28. First, a lower opening 24*a* of the housing 24 is detachably connected to an upper opening 10*a* of the reservoir tank 10 of the tank unit 22.

The overflow pipe 26 connects an overflow port 24*b* provided in a part of a sidewall of the housing 24 and the spouting pipe 8. The upstream side of the spouting pipe 8 is a connection conduit connected to a pump 30 of the tank device 4. The downstream side of the spouting pipe 8 is a connection conduit connected to a conduit (a rim conduit 2*d*) on the inside of the rim 2*c* of the toilet main body 2.

Further, the check valve 28 is provided in the overflow port 24*b* and enables the flush water in the housing 24 to flow into the overflow pipe 26 from the overflow port 24*b*. On the other hand, the check valve 28 can prevent the flush water in the overflow pipe 26 from flowing back into the housing 24.

As shown in FIG. 2, the tank unit 22 includes the reservoir tank 10 explained in detail below, the pump 30, a float switch 32, and a drain valve 34. The pump 30 is provided in a part (a halfway part) of the connection conduit (a water flow pipe 36) connected to the upstream side of the spouting pipe 8. An upstream end 36*a* of the water flow pipe 36 is connected to a downstream end 38*a* of a suction pipe 38 provided in the reservoir tank 10.

The flush water stored in the reservoir tank 10 is sucked into the water flow pipe 36 from the suction pipe 38 according to the operation of the pump 30 and thereafter pressure-fed to the spouting pipe 8 through the pump 30. The flush water supplied from the spouting pipe 8 to the rim conduit 2*d* of the toilet main body 2 is spouted into the bowl 2*a* from a spout port 2*e* at the downstream end of the rim conduit 2*d* and toilet cleaning is performed. In other words, the water flow pipe 36 and the spouting pipe 8, which are connection conduits connected to each other, function as a water supply pipe line for supplying, to the toilet main body 2, the flush water pressure-fed from the reservoir tank 10 by the pump 30.

The float switch 32 detects a water level of in the reservoir tank 10. An opening and closing motion of the electromagnetic valve 18 of the valve unit 14 is controlled based on the water level in the reservoir tank 10 detected by the float switch 32. For example, when the water level in the reservoir tank 10 detected by the float switch 32 is equal to or lower than a predetermined water level, the electromagnetic valve 18 opens and the water supply pipe 6 is opened. When the water level in the reservoir tank 10 reaches the predetermined water level, the electromagnetic valve 18 closes and the water supply pipe 6 is closed.

The drain valve 34 is provided on the bottom surface of the reservoir tank 10. The drain valve 34 is always closed during a normal use and is opened according to necessity and can discharge the flush water in the reservoir tank 10 to the outside.

Details of the reservoir tank 10 and the pump 30 of the tank unit 22 are explained with reference to FIGS. 3 to 6.

Figure 3:
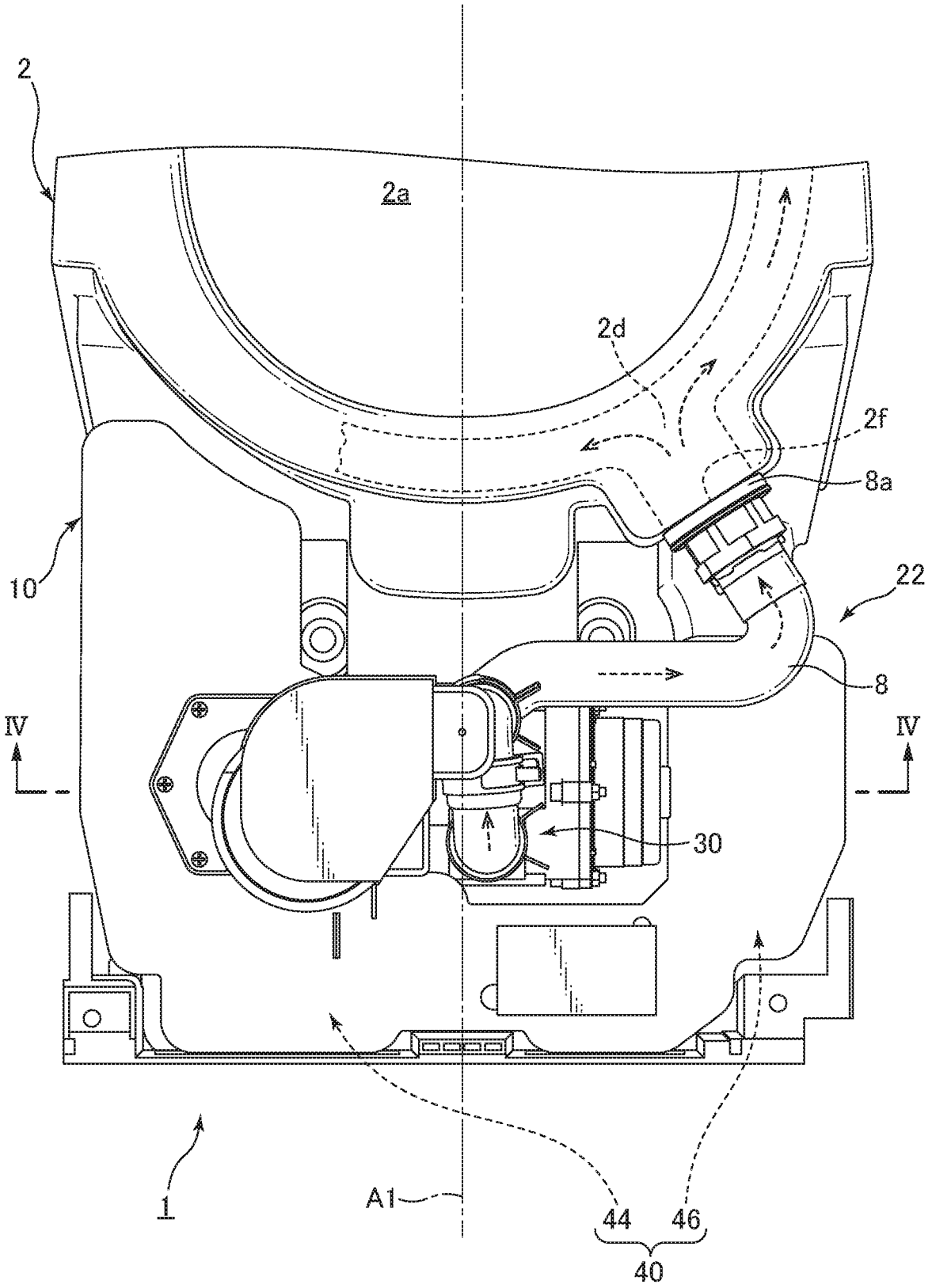
FIG. 3 is a partially enlarged plan view of a portion of a tank unit of the flush toilet according to the embodiment of the present disclosure.
Figure 4:
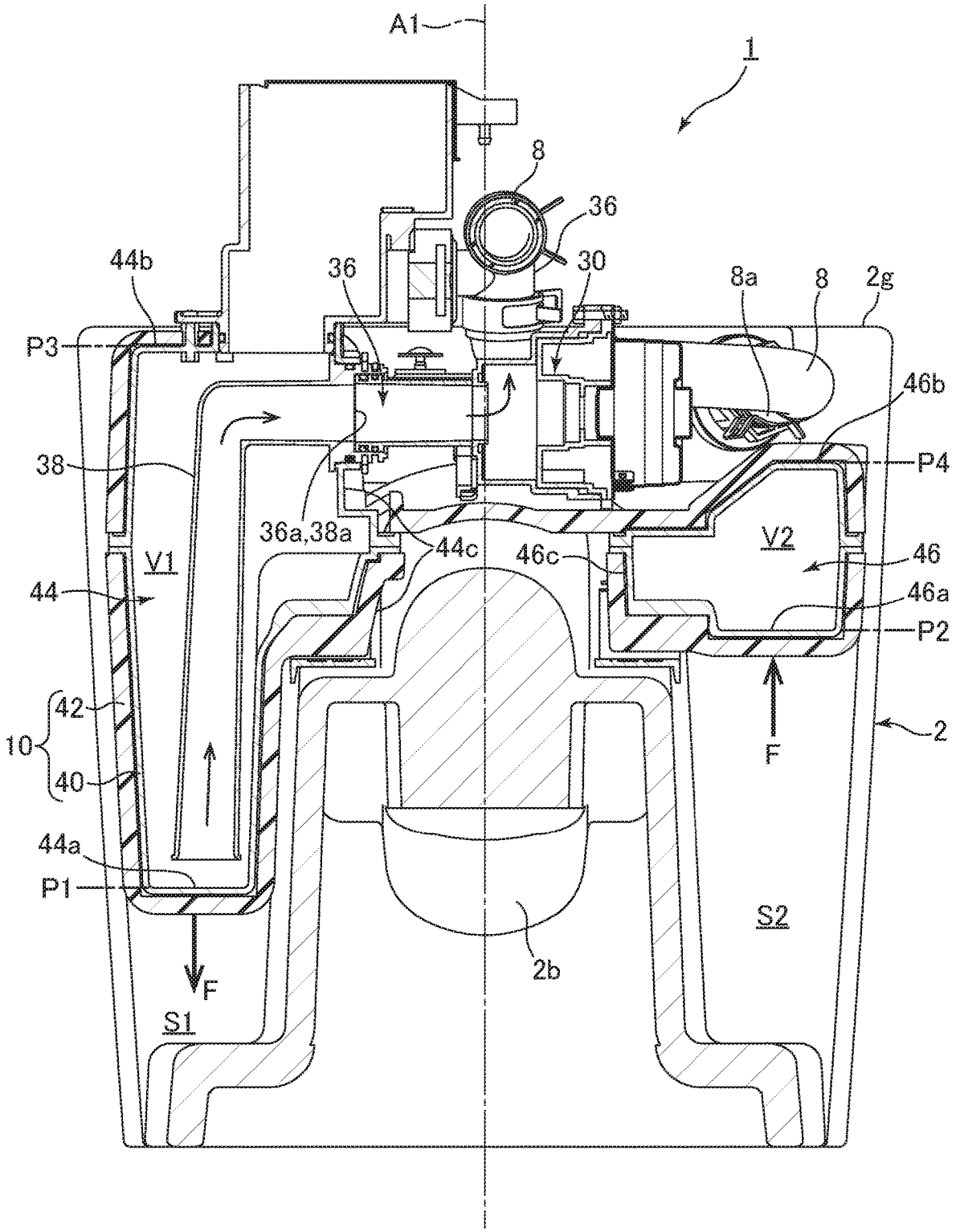
FIG. 4 is a sectional view taken along a IV-IV line in FIG. 3.

FIG. 3 is a partially enlarged plan view of a portion of the tank unit of the flush toilet according to the embodiment of the present disclosure. FIG. 4 is a sectional view taken along a IV-IV line in FIG. 3.

Figure 5:
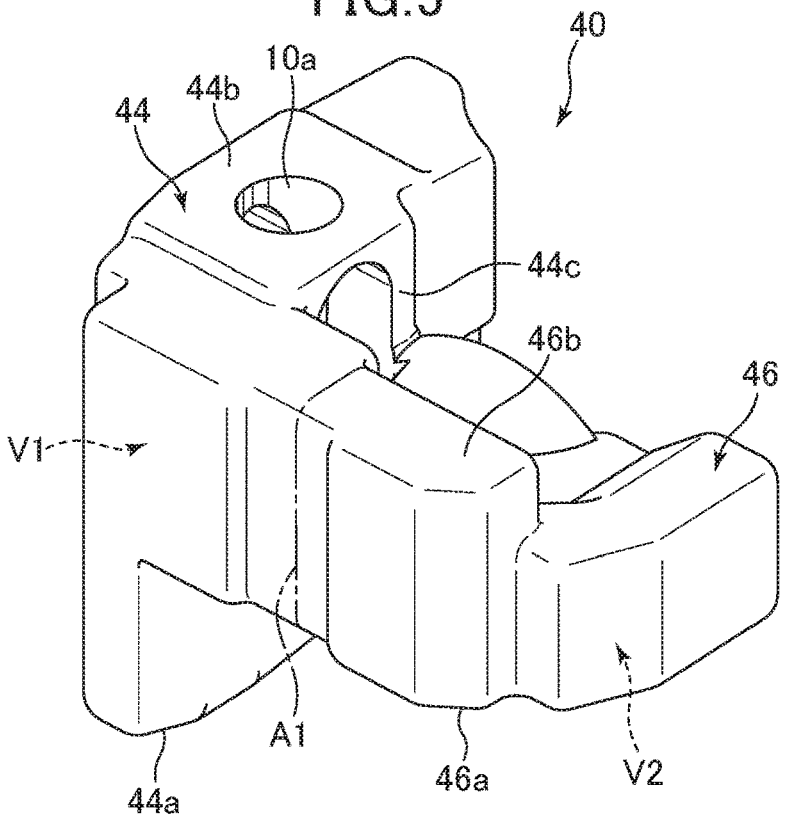
FIG. 5 is a perspective view of a tank body of a storage tank of the flush toilet according to the embodiment of the present disclosure viewed from obliquely behind and above.
Figure 6:
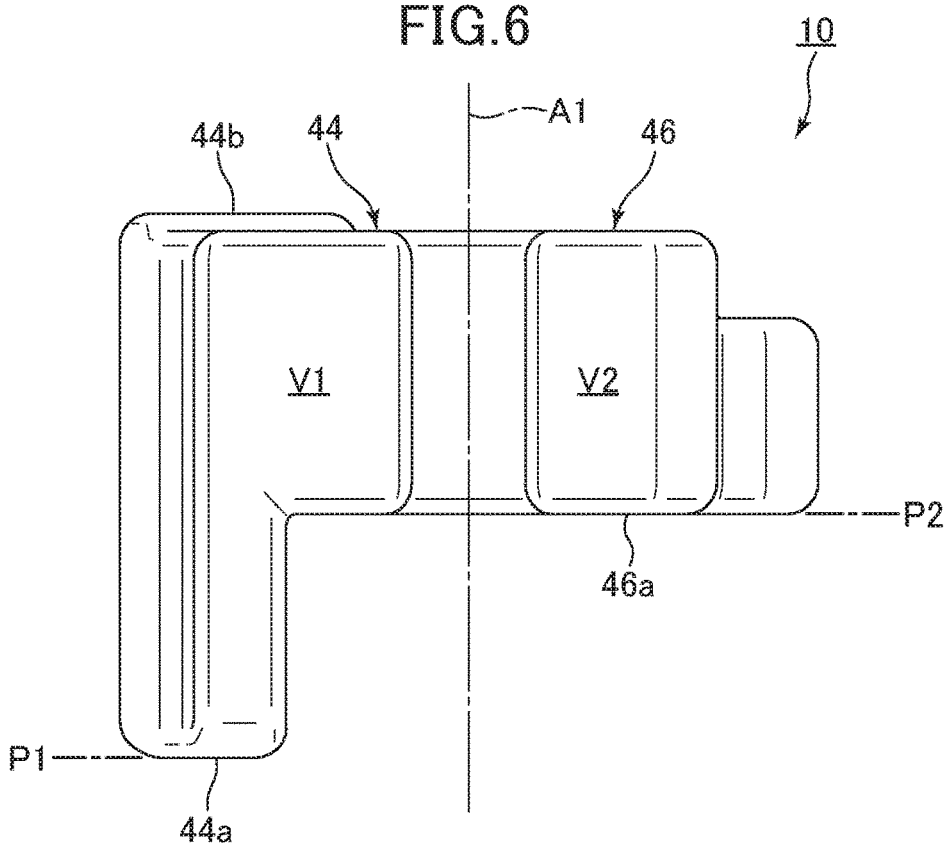
FIG. 6 is a rear view showing the tank body of the storage tank of the flush toilet according to the embodiment of the present disclosure.

First, as shown in FIGS. 3 and 4, the reservoir tank 10 of the tank unit 22 includes a single tank body 40 and a dew proof material 42 that covers the outer side of the tank body 40. FIG. 5 is a perspective view of the tank body of the storage tank of the flush toilet according to the embodiment of the present disclosure viewed from obliquely behind and above. FIG. 6 is a rear view showing the tank body of the storage tank of the flush toilet according to the embodiment of the present disclosure.

As shown in FIGS. 3 to 6, when an imaginary vertical plane dividing the reservoir tank 10 of the tank unit 22 into two at the left-right center is represented as "vertical plane A1", the single tank body 40 of the reservoir tank 10 includes a large tank portion 44 and a small tank portion 46 respectively on the left and the right with respect to the vertical plane A1. The tank body 40 is divided into two on the left and the right to be the large tank portion 44 and the small tank portion 46 by the vertical plane A1.

In other words, as shown in FIG. 4, the large tank portion 44 is disposed on the left side of the vertical plane A1 when the tank body 40 is viewed from the back side. The small tank portion 46 is disposed on the right side of the vertical plane A1 when the tank body 40 is viewed from the back side. A volume V1 of the large tank portion 44 is set larger than a volume V2 of the small tank portion 46 (V1>V2).

As shown in FIG. 4, the toilet main body 2 includes, in a region further on the rear side than the bowl 2*a*, a large tank compartment S1 and a small tank compartment S2 that respectively house the large tank portion 44 and the small tank portion 46 in positions above the floor surface. In other words, the large tank compartment S1 is formed on left-right one side with respect to the vertical plane A1 that divides the reservoir tank 10 into two at the left-right center (the left side of the vertical plane A1 when the toilet main body 2 is viewed from the back side) in the region further on the rear side than the bowl 2*a* of the toilet main body 2. On the other hand, the small tank compartment S2 is formed on the left-right other side with respect to the vertical plane A1 (the right side of the vertical plane A1 when the toilet main body 2 is viewed from the back side) in the region further on the rear side than the bowl 2*a* of the toilet main body 2.

As shown in FIGS. 4 to 6, in a state in which the large tank portion 44 and the small tank portion 46 are respectively set in the large tank compartment S1 and the small tank compartment S2, a lowest position P1 of a bottom surface 44*a* of the large tank portion 44 is located below a lowest position P2 of a bottom surface 46*a* of the small tank portion 46. Further, as shown in FIGS. 4 to 6, in the state in which the large tank portion 44 and the small tank portion 46 are respectively set in the large tank compartment S1 and the small tank compartment S2, a position P3 of an upper surface 44*b* of the large tank portion 44 is located above a position P4 of an upper surface 46*b* of the small tank portion 46 and is located below an upper surface 2*g* of the rim 2*c* of the toilet main body 2.

Additionally, in the state in which the large tank portion 44 and the small tank portion 46 are respectively set in the large tank compartment S1 and the small tank compartment S2, the position P3 of the upper surface 44*b* of the large tank portion 44 is the highest surface among the upper surface of the tank body 40. Further, the upper opening 10*a* serving as a water supply opening to the tank body 40 is disposed on the upper surface 44*b* of the large tank portion 44. Thus, the volume of the tank body 40 can be ensured while suppressing the height of the tank main body 40.

Incidentally, as shown in FIGS. 3 and 4, the suction pipe 38 is provided in the large tank portion 44 of the tank body 40. The upstream end 36*a* of the water flow pipe 36 connected to the upstream side of the spouting pipe 8 is water-tightly connected to the downstream end 38*a* of the suction pipe 38, which is a part of the large tank portion 44.

As shown in FIG. 3, a downstream end 8*a* of the spouting pipe 8 connected to the downstream side of the water flow pipe 36 is connected to an inlet 2*f* of the rim conduit 2*d* on the left-right other side with respect to the vertical plane A1 of the toilet main body 2 (further on the right side than the vertical plane A1 when the toilet main body 2 is viewed from the back side).

As shown in FIG. 4, a sidewall surface 44*c* on the vertical plane A1 side (the left-right center side) of the large tank portion 44 is disposed on the outer side of the discharge trap conduit 2*b* (the left side when the discharge trap conduit 2*b* is viewed from the back side) in the large tank compartment S1. Similarly, a sidewall surface 46*c* on the vertical plane A1 side (the left-right center side) of the small tank portion 46 is disposed on the outer side of the discharge trap conduit 2*b* (the right side when the discharge trap conduit 2*b* is viewed from the back side) in the small tank compartment S2.

As shown in FIGS. 4 and 5, the discharge trap conduit 2*b* is provided at the left-right center of the toilet main body 2. The upstream end 36*a* of the water flow pipe 36 is connected to the sidewall surface 44*c* on the discharge trap conduit 2*b* side of the left and right side surfaces of the large tank portion 44.

As shown in FIGS. 3 and 4, the pump 30 is disposed behind the bowl 2*a* of the toilet main body 2 and above the discharge trap conduit 2*b*. The pump 30 is provided further on the left-right center side of the toilet main body 2 than the upstream end 36*a* of the water flow pipe 36 and the downstream end 8*a* of the spouting pipe 8.

Action of the flush toilet 1 according to the embodiment of the present disclosure is explained with reference to FIGS. 1 to 6. First, with the flush toilet 1 according to this embodiment, in a state in which the reservoir tank 10 is set in the tank compartments S1 and S2 of the toilet main body 2, the volume V1 of the large tank portion 44 and the volume V2 of the small tank portion 46 of the tank body 40 of the reservoir tank 10 are different. Consequently, imbalance of weight in the tank body 40 occurs. Consequently, in some case, a tilt that places the large tank portion 44 having the larger volume below and places the small tank portion 46 having the smaller volume above occurs and a force F (see FIG. 4) for tilting the entire horizontal reservoir tank 10 acts on the horizontal reservoir tank 10.

However, even in such a state in which the force F for tilting the entire reservoir tank 10 occurs, the upstream end 36*a* of the water flow pipe 36 is connected to the downstream end 38*a* of the suction pipe 38, which is a part of the large tank portion 44, and the downstream end 8*a* of the spouting pipe 8 is connected to the inlet 2*f* of the rim conduit 2*d* on the left-right other side with respect to the vertical plane A1 of the toilet main body 2 (further on the right side than the vertical plane A1 when the toilet main body 2 is viewed from the back side). Consequently, the entire connection conduit from the upstream end 36*a* of the water flow pipe 36 to the downstream end 8*a* of the spouting pipe 8 can effectively restrain a tilting movement of the entire reservoir tank 10.

Therefore, the entire reservoir tank set in the tank compartments S1 and S2 of the toilet main body 2 can be maintained in the horizontal state. Therefore, it is possible to prevent the entire reservoir tank 10 set in the tank compartment from greatly tilting to collide with the toilet main body 2 and the floor surface to be broken.

With the flush toilet 1 according to this embodiment, as a space for setting each of the large tank portion 44 and the small tank portion 46 of the reservoir tank 10, a peripheral space on the outer side of the discharge trap conduit 2*b* can be used as a part of the tank compartments S1 and S2 of the toilet main body 2. Further, in a state in which the large tank portion 44 and the small tank portion 46 are respectively set in the large tank compartment S1 and the small tank compartment S2, the position P3 of the upper surface 44*b* of the large tank portion 44 is located above the position P4 of the upper surface 46*b* of the small tank portion 46 and located below the upper surface 2*g* of the rim 2*c* of the toilet main body 2.

Therefore, it is possible to sufficiently secure the volume in the reservoir tank in which the flush water is stored while limiting the height position of the entire reservoir tank 10. Accordingly, it is possible to realize so-called "low silhouetting" for designing the height of the entire flush toilet 1 including the toilet main body 2 and the tank device 4 low. Therefore, it is possible to improve a design property of the entire flush water toilet 1.

Further, in the flush toilet 1 according to this embodiment, the discharge trap conduit 2*b* is provided at the left-right center of the toilet main body 2. The upstream end 36*a* of the water flow pipe 36 is connected to the sidewall surface 44*c* on the discharge trap conduit 2*b* side of the left and right side surfaces of the large tank portion 44. Consequently, it is possible to position the upstream end 36*a* of the water flow pipe 36 closer to the left-light center of the toilet main body 2.

Therefore, it is possible to suppress the length and the height of the entire connection conduit from the upstream end 36*a* of the water flow pipe 36 positioned closer to the left-right center of the toilet main body 2 to the downstream end 8*a* of the spouting pipe 8 connected to the other side of the toilet main body 2 divided into two at the left-right center. Therefore, it is possible to realize low silhouetting of the flush toilet 1.

With the flush toilet 1 according to this embodiment, the pump can be incorporated in a part of the water flow pipe 36. The connection conduit of the water flow pipe 36 and the spouting pipe 8 can also be used as the water supply pipe line for supplying the flush water pressure-fed by the pump 30 to the rim conduit 2*d* of the toilet main body 2.

Therefore, functions from the pressure-feeding of the flush water in the tank body 40 to the supply of the flush water to the toilet main body 2 can be integrated in the connection conduit (the water flow pipe 36). Therefore, it is possible to suppress the number of components and manufacturing cost. It is possible to efficiently perform toilet cleaning.

Further, in the flush toilet 1 according to this embodiment, the pump 30 is disposed behind the bowl 2*a* of the toilet main body 2 and above the discharge trap conduit 2*b*. Consequently, it is possible to secure a work space in performing connection work, maintenance work, and the like in the pump 30.

Therefore, it is possible to easily perform maintenance and inspection and the like of the pump 30. It is possible to reduce a workload.

In the flush toilet 1 according to this embodiment, the pump 30 is provided further on the left-right center side of the toilet main body 2 than the upstream end 36*a* of the water flow pipe 36 and the downstream end 8*a* of the spouting pipe 8. Consequently, it is possible to set, in a well-balanced state, the length of a suction path for the pump 30 to suck the flush water from the suction pipe 38 in the tank body 40 into the water flow pipe 36 and the length of the supply path (the water supply pipe line) for pressure-feeding the flush water from the pump 30 to the toilet main body 2 through the spouting pipe 8. Therefore, since it is possible to efficiently supply the flush water in the tank body 40 to the toilet main body 2 with such a pump 30, it is possible to improve cleaning performance of the flush toilet 1.

Further, in the flush toilet 1 according to this embodiment, the bottom surface 44*a* of the large tank portion 44 of the tank body 40 is located below the bottom surface 46*a* of the small tank portion 46 of the tank body 40. The suction pipe 38 connected to the upstream end 36*a* of the water flow pipe 36 is provided in the large tank portion 44. Consequently, it is possible to efficiently supply the flush water in the tank body 40 from the suction pipe 38 to the rim conduit 2*d* of the toilet main body 2 through the water flow pipe 36 and the spouting pipe 8 during the operation of the pump 30.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet configured to discharge waste by flushing the flush toilet with flush water, the flush toilet comprising:

a toilet main body including a bowl configured to receive the waste, a discharge trap configured to discharge the waste in the bowl, and a tank compartment;

a flush water tank device provided above a floor surface and including a reservoir tank configured to store flush water supplied to the toilet main body, the reservoir tank being set in the tank compartment of the toilet main body;

a connection conduit configured to connect the reservoir tank and the toilet main body and supply, to the toilet main body, the flush water supplied from the reservoir tank, wherein the reservoir tank includes a large tank portion having a large volume in the reservoir tank when the reservoir tank is divided into two at a left-right center and a small tank portion having a small volume, smaller than the large volume, in the reservoir tank when the reservoir tank is divided into two at the left-right center, the large tank portion is disposed in the tank compartment formed on one side of the toilet main body divided into two at the left-right center, while the small tank portion is disposed in the tank compartment formed on another side of the toilet main body divided into two at the left-right center, and an upstream end of the connection conduit is connected to the large tank portion, while a downstream end of the connection conduit is connected to the another side of the toilet main body divided into two at the left-right center, and wherein an entire area of the downstream end of the connection conduit is connected to the another side of the toilet main body divided into two at the left-right center.

2. The flush toilet according to claim 1, wherein at least a part of the large tank portion is disposed on an outer side of the discharge trap in the tank compartment which is formed on the one side of the toilet main body divided into two at the left-right center, and at least a part of the small tank portion is disposed on an outer side of the discharge trap in the tank compartment which is formed on the another side of the toilet main body divided into two at the left-right center.

3. The flush toilet according to claim 2, wherein the discharge trap is provided at the left-right center of the toilet main body, and the upstream end of the connection conduit is connected to a discharge trap side surface of the large tank portion.

4. The flush toilet according to claim 1, wherein the connection conduit includes a pump configured to pressure-feed the flush water from the reservoir tank to a downstream side of the connection conduit; and a water supply pipe line configured to supply the flush water pressure-fed by the pump to the toilet main body.

5. The flush toilet according to claim 4, wherein the pump is disposed behind the bowl and above the discharge trap.

6. The flush toilet according to claim 4, wherein the pump is provided further on a left-right center side between the one side and the another side of the toilet main body than the upstream end and the downstream end of the connection conduit.

7. The flush toilet according to claim 4, wherein a bottom surface of the large tank portion is located below a bottom surface of the small tank portion, and a suction pipe connected to the upstream end of the connection conduit is provided in the large tank portion, and the pump is configured to suck the flush water in the reservoir tank from the suction pipe into the connection conduit during operation.

* * * * *